US007328890B2

(12) United States Patent
Kent

(10) Patent No.: US 7,328,890 B2
(45) Date of Patent: Feb. 12, 2008

(54) VARIABLE GEOMETRY WORKTABLE

(76) Inventor: Frank Michael John Kent, 39 quai de la Roquette, F-13200 Arles (FR)

( * ) Notice: Subject to any disclaimer, the term of this patent is extended or adjusted under 35 U.S.C. 154(b) by 143 days.

(21) Appl. No.: 10/505,290

(22) PCT Filed: Feb. 19, 2003

(86) PCT No.: PCT/GB03/00715

§ 371 (c)(1),
(2), (4) Date: May 9, 2005

(87) PCT Pub. No.: WO03/070432

PCT Pub. Date: Aug. 28, 2003

(65) Prior Publication Data

US 2005/0218577 A1 Oct. 6, 2005

(30) Foreign Application Priority Data

Feb. 19, 2002 (GB) ..... 0203788.5

(51) Int. Cl.
*B25B 1/02* (2006.01)

(52) U.S. Cl. ..... 269/139

(58) Field of Classification Search ..... 269/139, 269/147, 166–170, 138
See application file for complete search history.

(56) References Cited

U.S. PATENT DOCUMENTS

| | | | | |
|---|---|---|---|---|
| 1,583,611 | A * | 5/1926 | Seely | 269/146 |
| 2,555,217 | A | 5/1951 | Young | |
| 4,278,243 | A * | 7/1981 | Alessio | 269/16 |
| 4,909,491 | A | 3/1990 | Cheng | |
| 5,067,535 | A * | 11/1991 | Wolff | 144/286.1 |
| 6,058,990 | A | 5/2000 | Kent | |
| 6,089,556 | A * | 7/2000 | Whiteford | 269/149 |
| 6,179,116 | B1 | 1/2001 | Noniewicz et al. | |
| 6,554,264 | B1 * | 4/2003 | Alford | 269/147 |
| 7,090,210 | B2 * | 8/2006 | Lawrence et al. | 269/139 |
| 7,114,715 | B1 * | 10/2006 | Kirk | 269/147 |
| 2005/0218577 | A1 * | 10/2005 | Kent | 269/139 |

* cited by examiner

*Primary Examiner*—Lee D. Wilson
(74) *Attorney, Agent, or Firm*—Altera Law Group, LLC

(57) ABSTRACT

A worktable having a leg supports (2 & 3) linked by strut (4) in normal working mode may have its leg supports repositioned one with another for alterative working modes, here shown with leg support (3) providing an extension to the top frame support 1, an extension leg (18) connected by strut (4) supports leg support (3) in a horizontal plane and a sliding element (20) providing the same essential form features as the top frame support (1) permitting the operational footprint of jaws (7 & 9) to be extended over the elongated top frame support provided by leg support (3).

18 Claims, 7 Drawing Sheets

13
W
13
7
9
6
8
19
1
3
20
21
18
4
2

24
22
23
W
25
9
7
8
6
19
1
3
20
21
18
4
2

VARIABLE GEOMETRY WORKTABLE

The present invention relates to worktables and more particularly to portable worktables with clamping/displacement means wherein it is provided that the working height, the ground-angle-working-plane and the maximum-operational-footprint may be varied.

The original Black & Decker Workmate could be used at three heights: folded on the ground, at fully opened position or at a mid-way point where the short base legs are folded underneath the main structure of the worktable.

Also known are clamping tables in which the worktop may be pivoted to an angle to the horizontal without changing the geometric angle configuration of the basic leg support. Such angled worktops may serve a limited function in holding a drawing board or canvas for a painting for example but are essentially unsuitable in angled plane for any woodworking operation.

Also known are clamping tables in which there is a tightening jaw and a fixed jaw in which the fixed jaw may be fitted at several points on the top frame. Clearly at each point the maximum opening capacity of the jaws is varied but the maximum-operational-footprint for the jaws is not: it remains always at the furthest fixing point for the fixed jaw relative to the tightening jaw. Extensions to the worktop of such clamping tables are also known, normally in the form of clip on trays on which tools may be placed but these do not increase the maximum-operational-footprint of the clamping/displacement means.

In the light of this known art the new provisions of the present invention may now be described and clearly defined.

The primary aim of this invention is to provide a compact clamping/displacement worktable system wherein the maximum capacity to hold a workpiece may be varied by varying the geometrical configuration of the worktable structure such that in standard mode, for example, it may be suited to holding a small to medium sized workpiece and in extended mode may be doubled in capacity to hold a door, for example.

In the terms of this invention "clamping/displacement worktable" means a worktable having means for displaceing one worktop section relative to another wherein these worktop sections are operatively cooperative, for example, two worktop sections as the jaws of a clamp tightened together to hold a workpiece or, for another example, a worktop section with attached fence guide displaceably adjustable with a worktop section holding a circular saw for purposes of determining the width of saw cut.

In the terms of this invention "worktop section" means the primary supporting structure for workpieces and tools: it does not include any element placed on or attached to the surface of the said worktop section and dependent on it for support. A worktop section would normally, but not necessarily, have a planar surface: for example a round section tube fixed at each end to a worktop section mount, the said tube spanning the worktable to support a workpiece or tool would in the terms of this invention be defined as a "worktop section" and even a simple block each side of the table at worktop section height without any spanning of the table would, in terms of its function of supporting a workpiece at worktop section height, be considerd a worktop section.

In the terms of this invention "maximum-operational-footprint" means the maximum area over which two or more operationally cooperative worktop sections may function given any mode or geometric configuration for the leg support and top frame support structure.

The secondary aim of this invention is to provide a working plane for two or more operationally cooperative worktop sections, the said plane being set at one or more angles to the ground. The operational footprint of the said worktop sections starting, at the control end of the worktable, at more or less normal working height and extending down towards the ground. This angled working plane is extemely useful in, for example, the circular sawing of thick planks where the line of the force involved in the operation is directed towards the ground eliminating any possibility of the worktable moving away from the said force.

In the terms of this invention a "ground-angle-working-plane" is a plane wherein the worktop sections may be angled in a line from normal working height towards the ground and wherein the top frame and top frame extension extend in parallel angled line to the ground to provide stable support and if required extension to ground level of the maximum-operational-footprint of the said worktop sections.

The Variable Geometry Worktable described in this invention may simultaneously provide the three reqirements of: variable working height, variable maximum-operational-footprint and variable ground-angle-working-plane. All three of the said requirements are achieved essentially by releasing the folding leg support structure from a singly determined linked relationship or put in another way . . . providing the means whereby the distance between two directly-linked, cooperatively-articulating axis points on a folding leg support structure may be varied either by releasing the link or by adjusting its length. "Directly-linked" in the terms of this invention means that there are no intermediate cooperatively articulating axis points;

Embodiments of the invention will now be described, by way of example only, with reference to the accompanying drawings, in which FIG. 1 is a side view of a Variable Geometry Worktable (VGW) in folded position;

Figure 1:
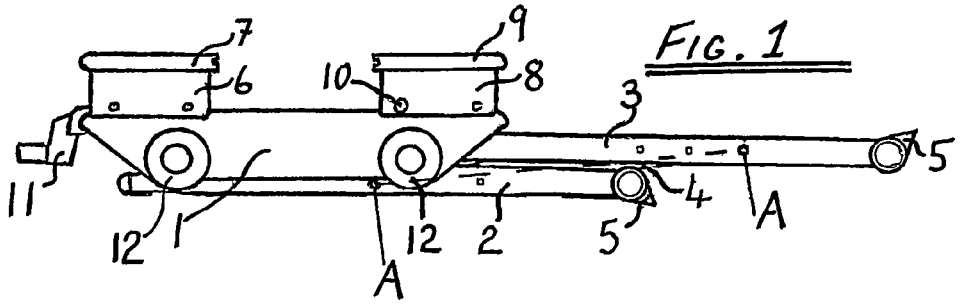
Figure 2:
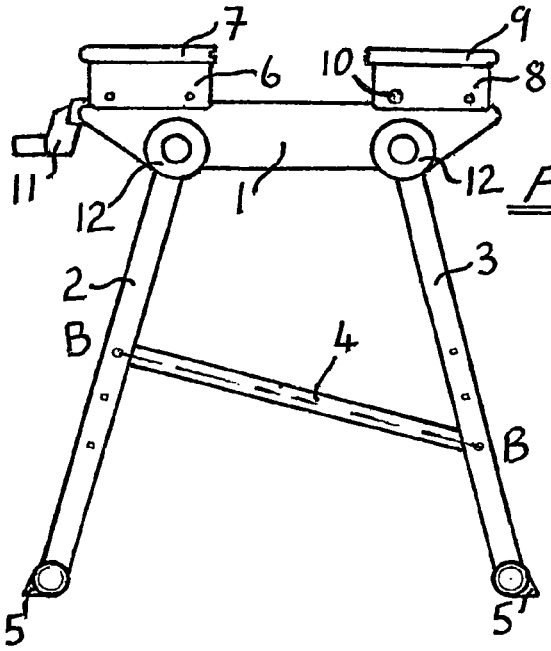
FIG. 2 is a side view of the same VGW in open, normal-working-position.

Referring to FIGS. 1 & 2 the folded and open, normal-working-position respectively in the preferred forms of the invention, a Variable Geometry Worktable (VGW) comprises a top frame 1 under which both control-end leg support 2 and far-end leg support 3 fold in parallel alignment, the control-end leg support resting under the far-end leg support, the two legs supports being joined in both folded and normal-working-position by a strut 4, at the end of each leg support there being a foot 5 suitable in shape for variable positioning and fixed to the top frame at the control-end a worktop section mount 6 to which is attached a worktop section 7 and at the far-end a worktop section mount 8 selectively displaceable along the top frame together with its attached worktop section 9, a control button 10 locking it when required to a clamping/displacement means operated by winding handle 11 at the control-end and a rondel 12 at each end masking the control elements for keeping the leg supports in rigid open position.

Figure 3:
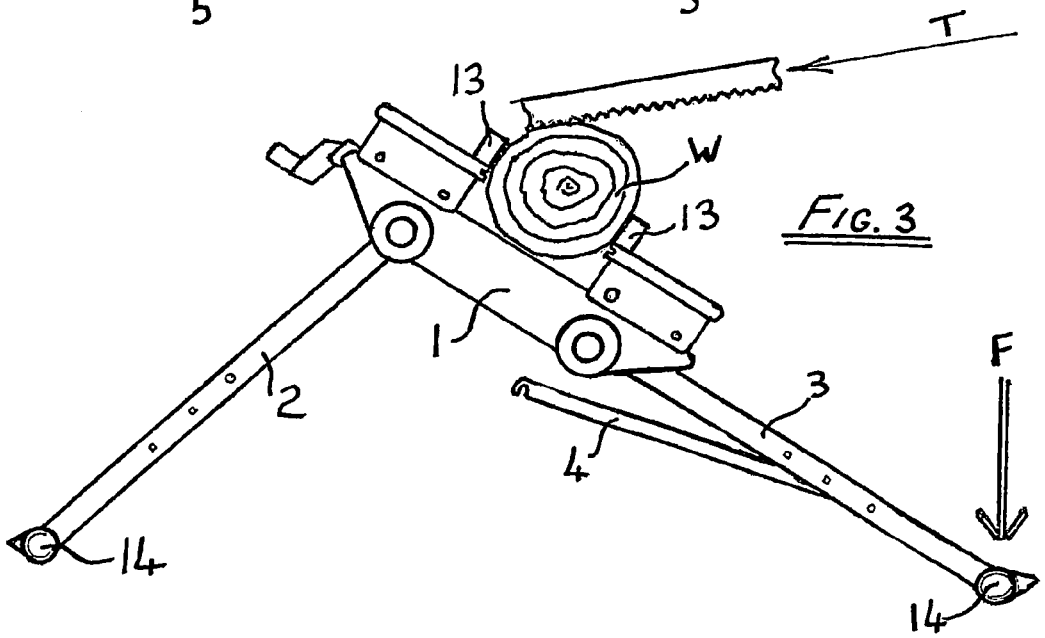
FIG. 3 is a side view of the same VGW in ground-angle-working-plane.

In FIG. 3 the VGW is shown in a ground-angle-working-plane the control-end legs being still locked in the same angle relative to the top frame as shown in FIG. 2 opening of the strut on the control-end leg support permitting the far-end leg support to be released and simultaneously placed parallel with the top frame in folded position the VGW in this configuration providing a much lower working height suitable for example for sawing a log wherin the displaceable worktop section in the mode of tightening jaw may hold the workpiece W helped by clamping blocks 13 attached to the worktop section surface the arrow F showing the position for the feet to be placed on a ground level cross-piece tube 14 joining far-end leg supports the arrow T inticating the action direction of the tool in this case a hand saw.

Figure 4:
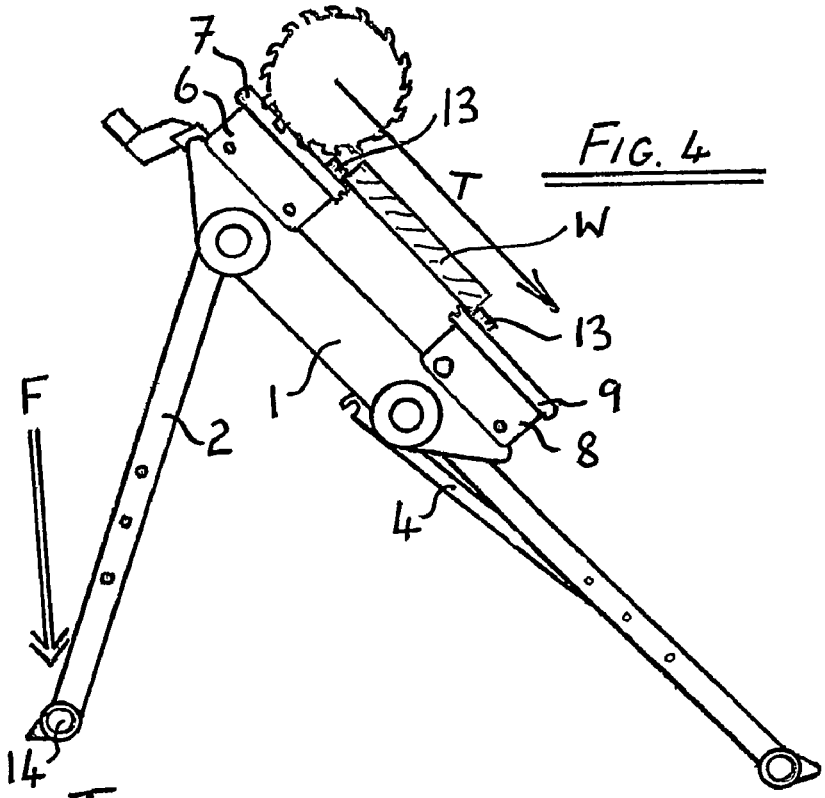
FIG. 4 is a side view of the same VGW set in a higher, steeper ground-angle-working-plane.
Figure 5:
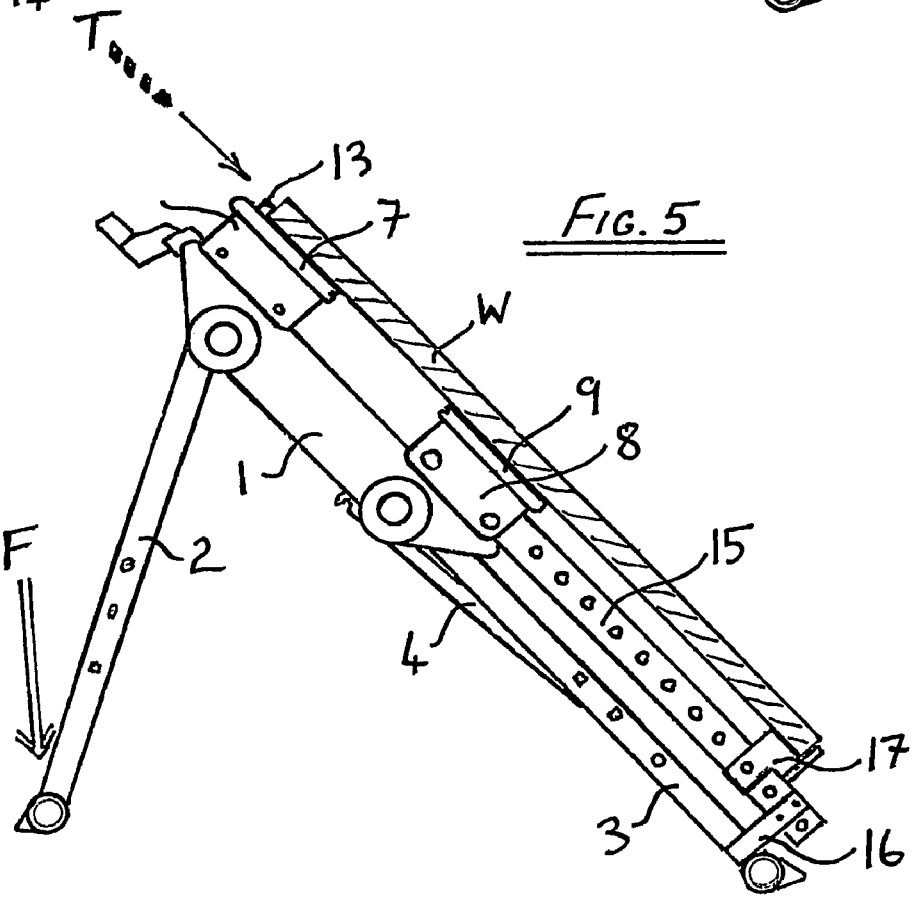
FIG. 5 is a side view of the same VGW set in the same angle-plane as in FIG. 4 but with an operational-footprint for the worktop sections extending almost to the ground.

In FIG. 4 the VGW is shown in another ground-angle-working-plane the far-end leg support still in fully folded position relative to the top frame but the control-end leg support is locked in a slightly more closed position resulting in an initially higher or more normal working height and a steeper ground-angle-working-plane suitable for example for circular saw cross-cutting of thick planks the foot being in this case placed on the tubular ground level cross piece of the control-end leg supports the action direction of the tool in this case a circular saw being in a steep line to the ground preventing the VGW from moving away from the power tool pressure. It should be noted that in going from normal folded position as in FIG. 1 to normal-working-position as in FIG. 2 the leg supports go through many angle changes relative to the top frame and to each other as they do in most folding worktables the relevance of the VGW system being that it separates where necessary the link between control-end and far-end leg support and that it locks the angle between them at specific useful working configurations or in the terms of this invention at "operational angles" between the leg supports. In FIG. 5 the VGW is shown in the same ground-angle-working-plane as in FIG. 4 but an extension clamping bar 15 attached at one end to the inside face of displaceable or tightenable worktop section mount is supported at the distal end by a slider support 16 which is attached to and may slide along the far-end leg support which in this configuration serves a dual function of leg support and top frame extension support, an extension bar block 17 which may support a workpiece at the level of worktop sections 7&9 and in the terms of this invention itself considered a worktop section is selectively positionable along the extension bar, activation of the clamping/displacement means situated on the original top frame support 1 tightening worktop section mount 8 towards the fixed worktop section 7 but equally tightening worktop section 17 towards worktop section 7 effectively increasing the maximum-operational-footprint of the VGW in this configuration by a factor of 2 relative to the normal-working-position. The workpiece W shown here by way of example is a door and the direction action shown for the tool T is that for a drill to drill a slot for the fixing of a lock.

Figure 6:
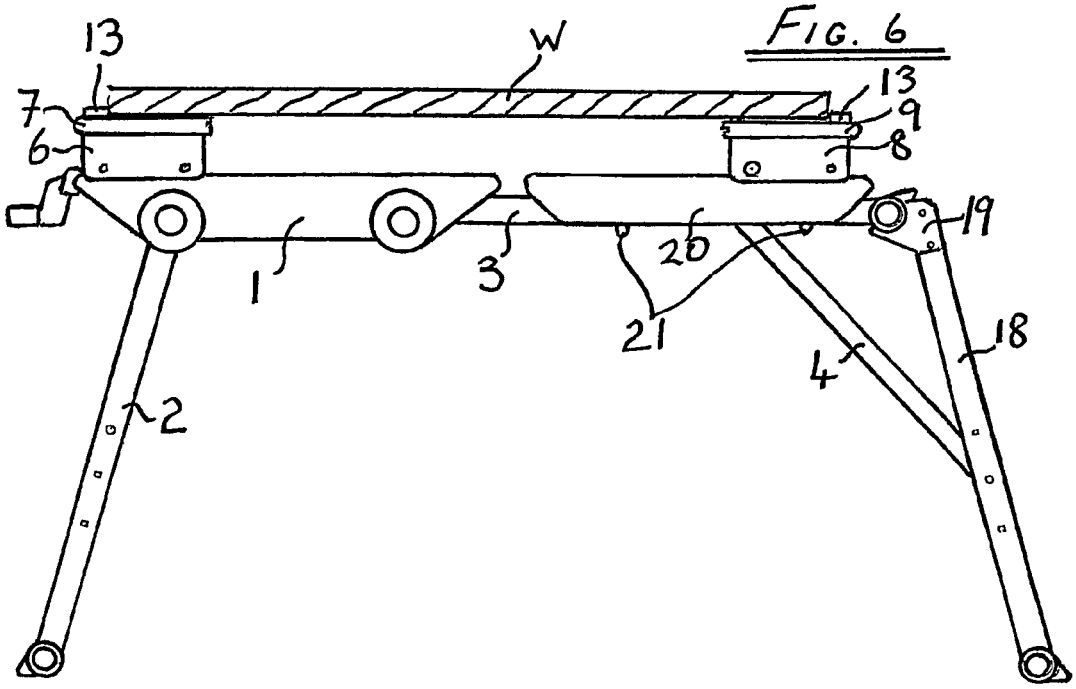
FIG. 6 is a side view of the same VGW with the orinal leg supports set at the same angle to each other as in FIG. 3 but with an additional extension-leg support holding the original folded leg support in an extended horizontal plane.

In FIG. 6 the control-end and far-end leg supports have been set in the operational-angle shown in FIG. 3 but an extension leg support 18 holds the far-end leg support 3 in a horizontal plane connecting with the foot of leg support 3 by means of linking element 19 and being also held by the distal end of strut 4 still attached at its axis to the far-end leg support which in this configuration of the VGW no longer serves in the mode of leg support but only in the mode of top frame extension support.

A preferred system of increasing maximum-operational-footprint to that described in FIG. 5 is here shown in FIG. 6 a top frame aligner 20 reproducing the essential form and feature characteristics of the original top frame support 1 and the essential form and feature characteristics of a displaceable clamping device mounted underneath the original top frame support the said top frame aligner being itself displaceable along the top frame extension support 3 by means of sliders 21 the feature characteristics of the top frame aligner permitting the displaceable worktop mount 8 to be selectively positioned and fixed along the length of the said top frame aligner in the same manner that it may be positioned and fixed along the length of the displaceable clamping device situated under the original top frame support the said top frame aligner also being linked to the displaceable clamping device under the original top frame support 1 may be tightened towards fixed worktop section 7.

Figure 7:
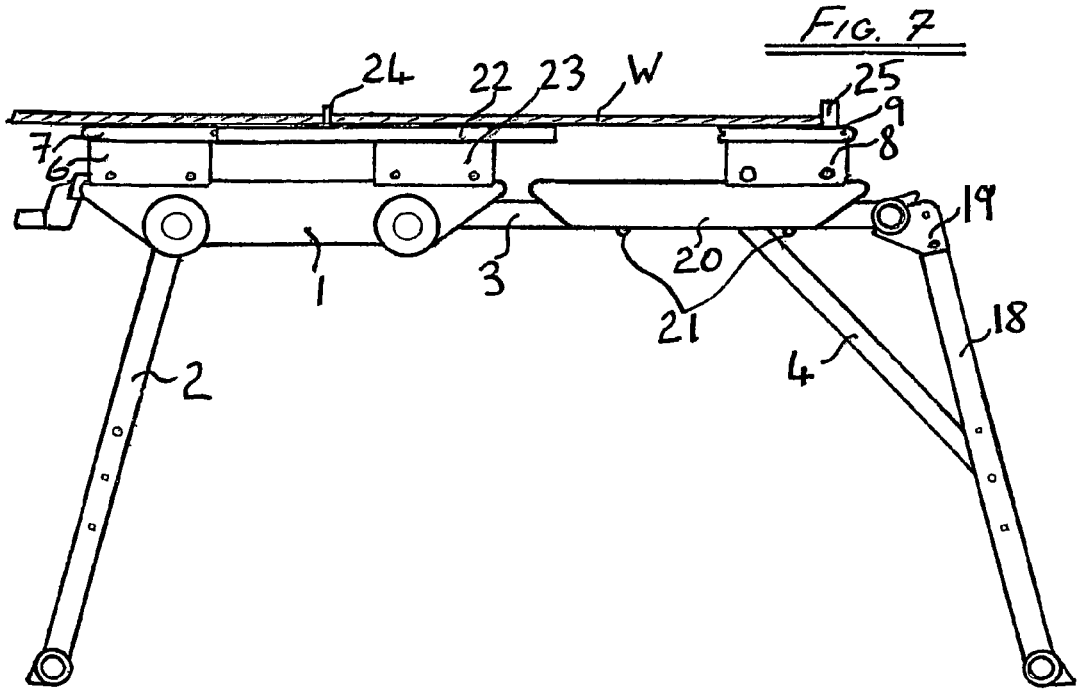
FIG. 7 is a side view of the same VGW set in similar configuration as in FIG. 6 but disposing a tool plate in the middle and a fence guide attached to a worktop section to the right.

In FIG. 7 the VGW is shown in a similar configuration to that of FIG. 6 but with the worktop sections no longer functioning as clamping jaw elements, instead another worktop section in the form of a tool plate 22 to which a power tool, for example a circular saw, may be attached from underneath is supported by a worktop section mount 23 which is set in fixed position on the top frame support 1 the displaceable worktop mount 8 carrying worktop section 9 to which a fence guide 25 has been attached the clamping/displacement means of the VGW adjusting the distance between saw blade 24 and fence guide 25.

Figure 8:
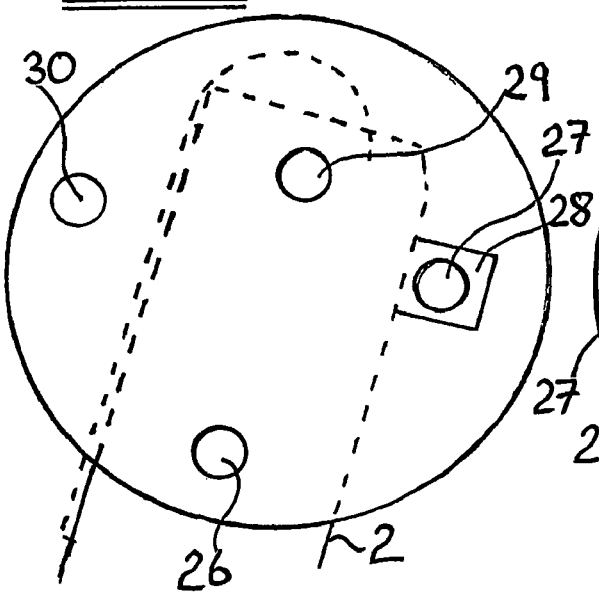
FIGS. 8 & 9 are side views of the control layout at the axis point for the control-end and far-end leg supports respectively.

In FIG. 8 is shown the control layout on the top frame support behind rondel 12 for the control-end leg support, the axis point for the said leg support with the top frame being situated at point 26 the said leg support 2 opening to a point where it is blocked by a bolt and square nut 27 & 28 respectively a spring loaded bolt on the said leg support engaging with the top frame support at position 29 for the normal-working-position angle as shown in FIG. 2 and at position 30 for the operational angle for the control-end leg structure as shown in FIGS. 4 & 5. The general provisions of the invention do not preclude other operational-angle positions or indeed other means, such as tightening means for locking the leg supports at a selected angle to the top frame.

Figure 9:
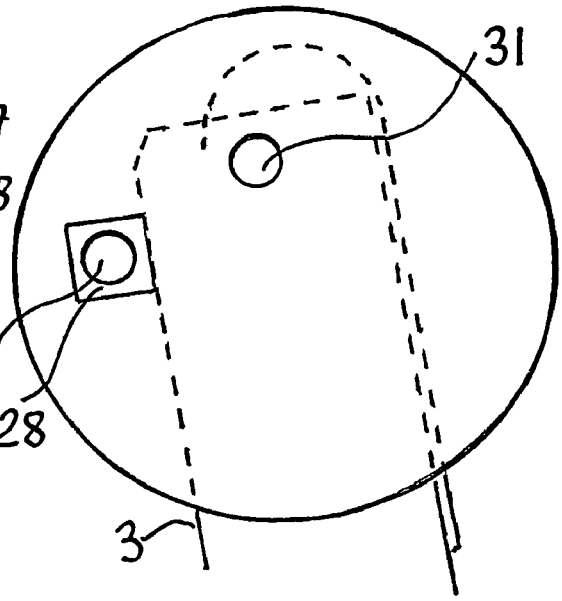

In FIG. 9 is shown the control layout on the top frame behind rondel 12 for the far-end leg support the axis point for the said leg support being at a higher point 31 than for the control-end leg but the opening of the far-end leg support is similarly blocked at a certain point by a bolt and square nut 27 & 28 respectively. In normal-working-position the strut 4 holds the two legs together pulling the far-end leg support against its blocking nut 28 and pulling the control-end leg support back agaist its locking bolt 29*a*.

Figure 10:
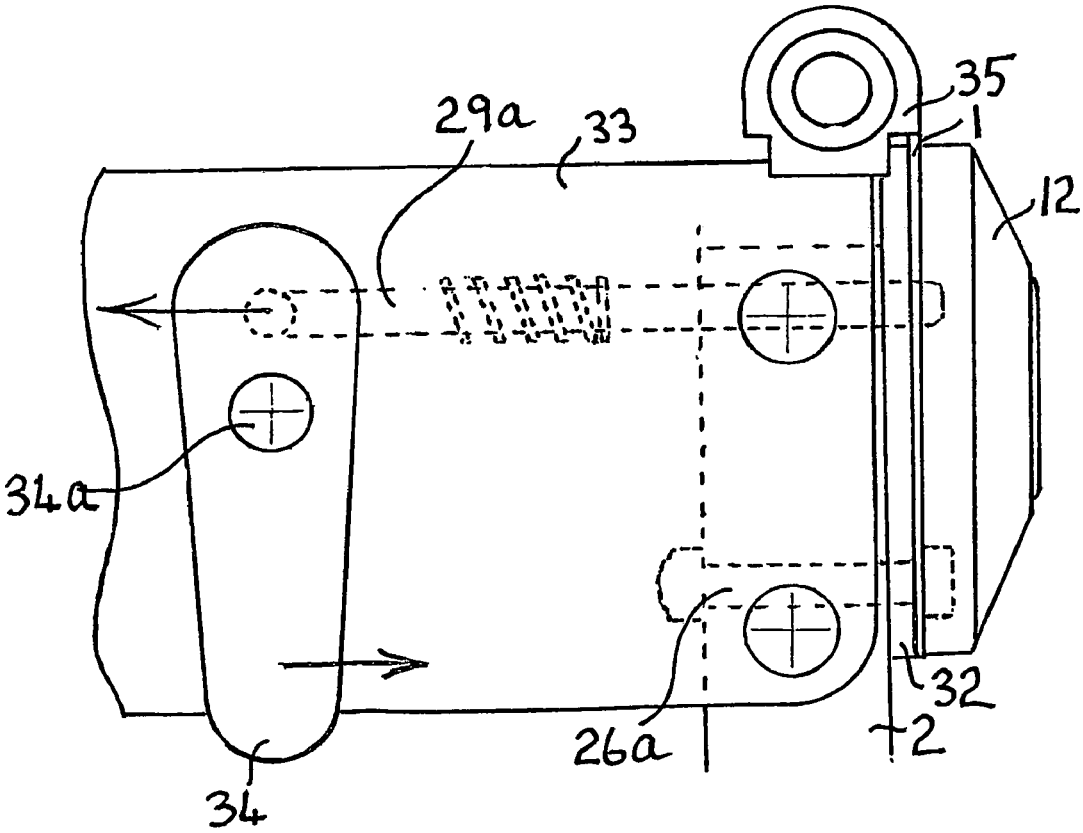
FIG. 10 is a schematic end view of the leg lock bolt at the control-end of the VGW.

In FIG. 10 is shown a partial end view of a VGW about the point of the contol-end leg support axis in which a leg axis washer 32 lies between the said leg support 2 and top frame support 1 a top cross-piece 33 joining control-end leg supports at either side of the VGW the said cross-piece supporting a leg locking system at either end comprising a spring loaded bolt 29*a* which is activated by a handle 34 which when turned towards the leg support around an axis 34*a* pulls the leg locking bolt out of its locating hole 29 in the top frame releasing the leg support to be repositioned at another angle locating point in the top frame, for example 30 or to be fully folded. The position of the leg axis bolt 26*a* which joins the leg support to the top frame is also indicated. An element 35 is inserted into the end of the top frame support primarily to hold the clamping means (the clamping handle which would normally be fitted at this point not being shown), the flat underside of a similar said element 35 positioned at the far-end of the top frame support precisely blocking the folded position alignment of the far-end leg support parallel to the top frame support.

Figure 11:
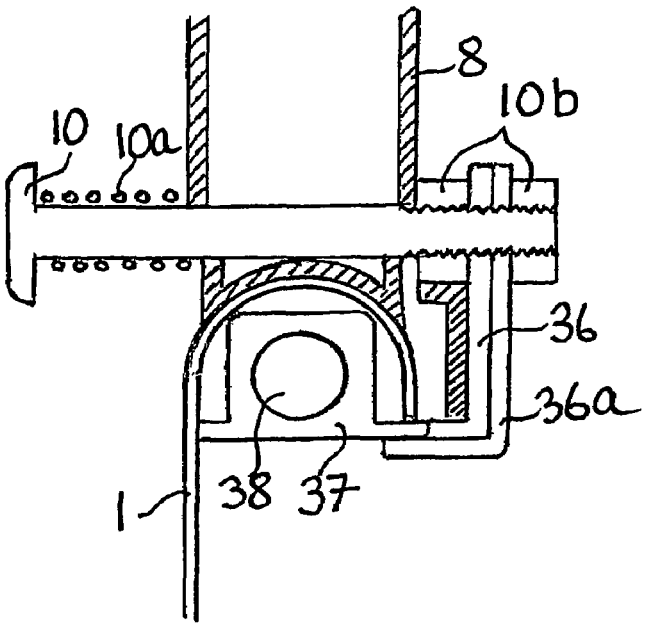
FIG. 11 is a schematic cross-section view showing the positioning and interlocking mechanism on the worktop section mount which attaches it to the clamping plate shown in FIG. 13.

In FIG. 11 is shown a quick-fit/quick-release system for positioning a displaceable worktop mount 8 comprising a control bolt 10 with spring return 10*a*, fitted at the distal by the means of two nuts 10*b* a toothed section 36 which interlocks with a toothed section 37*a* on a displaceable clamping plate 37 and a retention plate 36*a* which fits under the clamping plate 37 the said clamping plate being displaced by a tightening thread 38 which runs through it the said thread being turned by handle 11 at the control end of the VGW.

Figure 12:
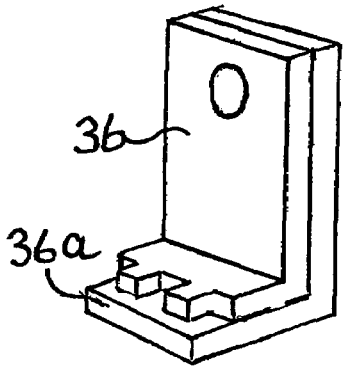
FIG. 12 is a three-dimensional sketch of the toothed interlocking element shown in FIG. 11.

In FIG. 12 is shown the interlocking toothed element 36 and the retention plate 36*a*. When the control bolt is pushed releasing the toothed interlocking section the retention plate still keeps the worktop mount firmly attached to the top frame support.

Figure 13:
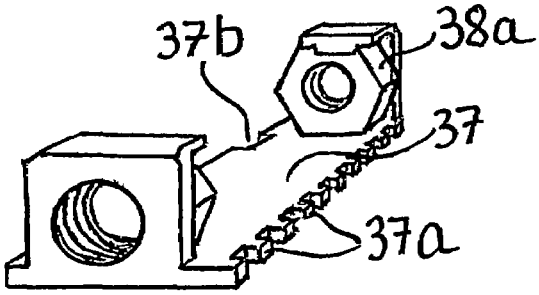
FIG. 13 is a three-dimensional sketch of the clamping plate to which the interlocking elements shown in FIGS. 11 & 12 attach themselves.

In FIG. 13 is shown the displaceable clamping plate 37 with toothed section 37*a* and two enfolded nuts 38*a* through which the tightening thread 38 may run. A slot 37*b* in the displaceable clamping plate provides a point to which a linked top frame aligner may be joined.

Figure 14:
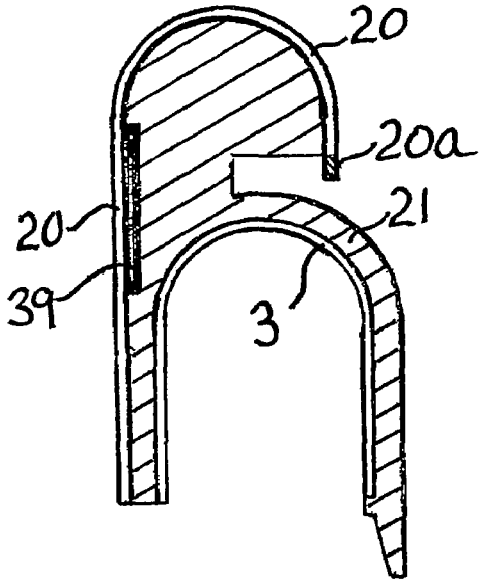
FIG. 14 is a schematic, cross-section view of the top frame aliner with slider attached to the folded far-end leg support.

In FIG. 14 is shown a cross-sectional view of the top frame aligner 20 mounted by means of a slider 21 onto the top frame extension support 3 the part 20*a* marking a toothed profile on the top frame aligner and 39 marking the attachment point of an element which joins the top frame aligner with the displaceable clamping plate 37.

Figure 15:
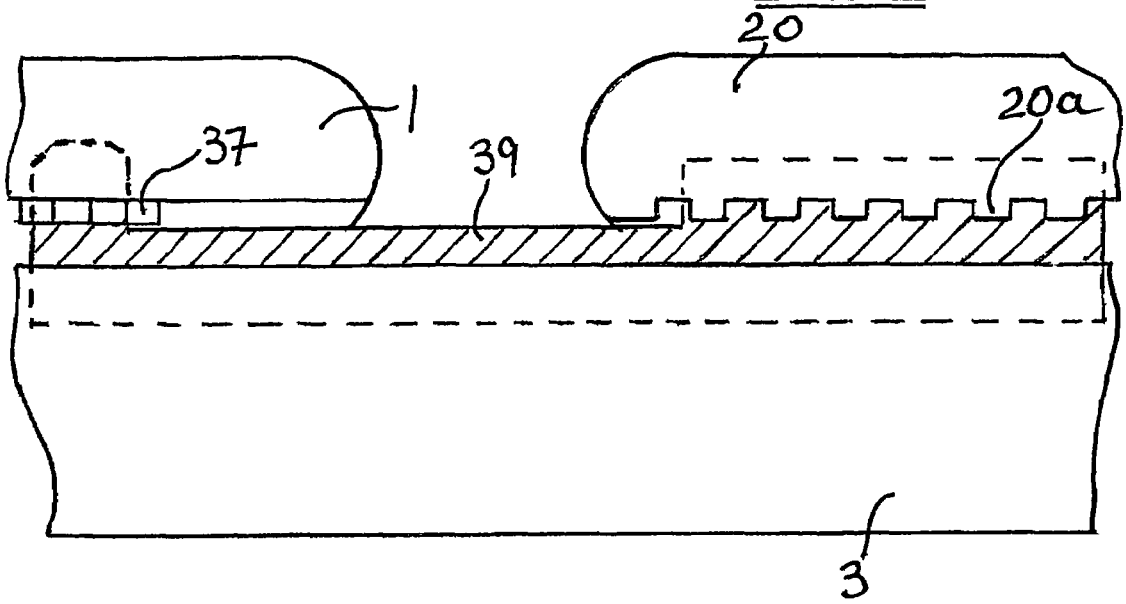
FIG. 15 is a schematic side view of the point at which the top frame aligner is linked to the clamping plate under the top frame.

In FIG. 15 is shown from the inside face of the top frame support 1 and the inside face of the top frame aligner 20 the linking element 39 which attaches the top frame aligner with the slot in the displaceable clamping plate 37.

FIGS. 11-15 describe an embodiment of a clamping/displacement system which may be simply extended from a shorter maximum-operational-footprint for the worktop sections to an extended maximum-operational-footprint on a VGW. The very rapid adjustment of a tightening jaw is however useful even for conventional worktables. The principles of the system, which in the terms of this invention is called a "clamping/displacement overide system" are as follows: the clamping/displacement means (handle and tightening thread in the described embodiment) activates a primary clamping/displacement vehicle (clamping plate) along which a secondary clamping/displacement vehicle (displaceable worktop section mount) may be selectively positioned and fixed, the secondary clamping displacement vehicle being employed to displace the worktop section over a larger distance along the length of the primary vehicle and any etension linked to it (top frame aligner) to a selected fixing point on the said primary vehicle or extension linked to it, the primary vehicle being employed to tighten and/or displacementally adjust the secondary vehicle with any attached worktop section over the remaining smaller distance. It should be noted in FIG. 5 element 17 is a tertiary clamping displacement vehicle displaceable along the extension 15 of the secondary vehicle, the displaceable worktop section mount 8.

Figure 16:
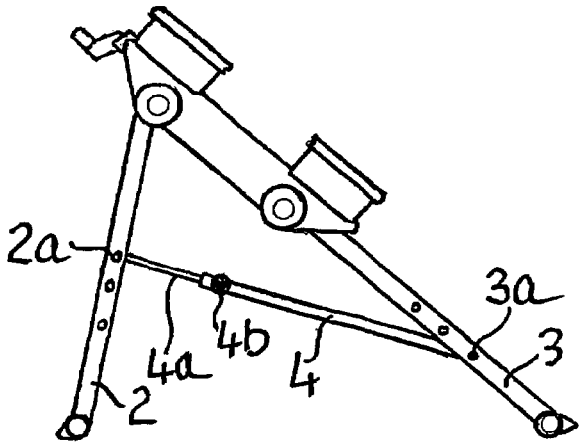
FIG. 16 is a side view of the VGW with telescopic strut support linking the leg supports.

FIG. 16 is shown a telescopic strut 4 joining leg supports 2&3 a telescopically extendable portion 4*a* locked into position by tightening means 4*b* permits the distance between the directly-linked, cooperatively-articulating strut axis points 2*a* & 3*a* to be varied while at the same time still remaining linked. The general provisions of the invention do not exclude other ways in which the distance between the strut axis points on the leg supports may be varied but linked.

Figure 17:
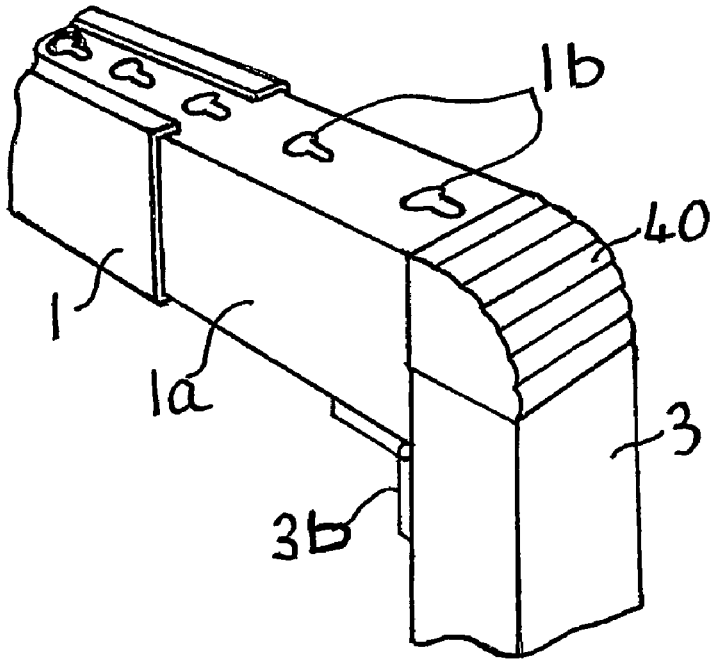
FIG. 17 is a partial view of a telescopic top frame support.

In FIG. 17 is shown an alternative embodiment for varying the maximum-operational-footprint for the worktop sections in which the top frame support 1 has a telescopic extendable section 1*a* with fitting points 1*b* for the attachment at variable points of a fixed worktop section, the leg axis point 3*b* of the far-end leg 3 may be extended away from the leg axis point of the control-end leg support the adjustable length top frame being the direct-link between the two operatively articulating leg axis points. In this embodiment the control-end leg supports may rest in a more or less vertical open position and the far-end leg supprt may be folded inwards the extended top frame being angled down to the ground so that element 40 on the top of leg support 3 becomes the foot of the far-end leg support when the said support is in folded position. In this embodiment the tightening/displaceable worktop section is situated at the control end of the VGW.

Figure 18:
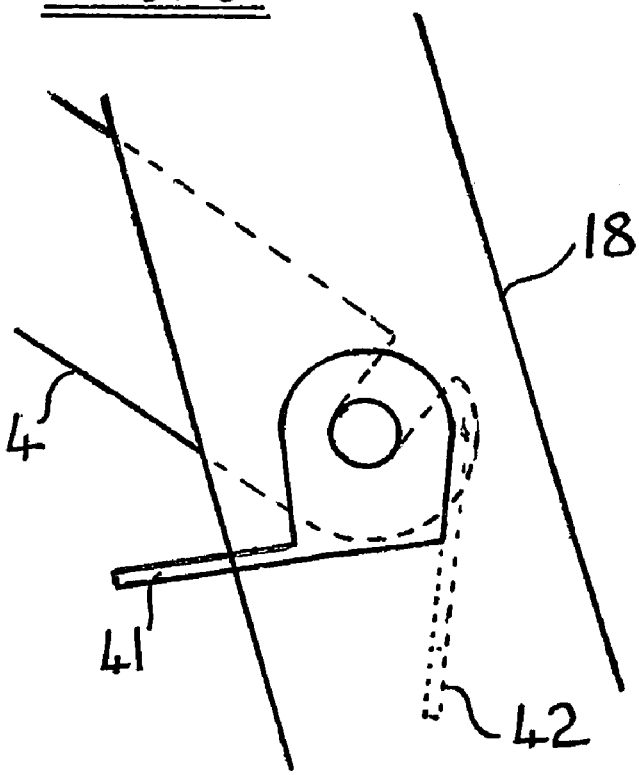
FIG. 18 is a side schematic view of a strut lock.

In FIG. 18 is shown the locked and open position 41 & 42 respectively of a strut lock which may act as a quick-fit/quick-release system for the attachment of a strut to a leg support. The strut position here shown is that of FIGS. 6 & 7 where the strut joins in upside down position the extension leg support 18 the strut lock is spring loaded in locked position so the strut is not free to fall away from its attachment point.

The invention claimed is:

1. A portable clamping/displacement worktable system, comprising:

a top frame;

a supporting structure supporting the top frame;

at least two operatively cooperative worktop sections provided on the top frame, wherein at least one worktop section is displaceable relative to another;

means for varying a maximum potential footprint of the worktop section operation by varying the length of the top frame supporting structure;

means for fitting and operating a worktop section both on a shorter and extended top frame support;

means for extending the functioning of a mechanism situated on a shorter top frame footprint to an extended top frame footprint; and means for varying the distance between two directly-linked, cooperatively-articulating axis points on a folding leg support structure.

2. A worktable system according to claim 1 in which the said direct link between two cooperatively-articulating axis points may be released or refitted with quick-fit/quick release means.

3. A worktable system according to claim 2 in which quick adjustment means are provided to vary the length of any said direct link between two cooperatively-articulating axis points.

4. A worktable system according to claim 3 in which the operational-angle and or distance between the leg supports may be adjusted to provide an extended top frame support.

5. A worktable system according to claim 4 in which an extended top frame support is provided by positioning the far-end leg support in folded or closed position in a line parallel to the top frame while simultaneously positioning the control-end leg support in an open, relatively vertical plane.

6. A worktable system according to claim 5 in which at least one ground-angle-working-plane is provided for the worktop sections by changing the operational angle or distance between the leg supports.

7. A worktable system according to claim 5 in which at least one ground-angle-working-plane is provided for the worktop sections by changing the operational angle and distance between the leg supports.

8. A worktable system according to claim 7 in which at least one ground-angle-working-plane is provided for the worktop sections by the leg support alignment described in claim 8 wherein the foot of the far-end leg support rests on the ground, the far-end support in this configuration serving as both leg support and top frame extension.

9. A worktable system according to claim 8 in which an extended maximum-operational-footprint for the worktop sections is provided in a horizontal operational plane by the leg support alignment described, in claim 5 wherein the foot end of the far-end leg is supported by an extension leg support, the far-end leg support in this configuration positioned in a horizontal operational plane and serving in this mode only as top frame extension.

10. A worktable system according to claim 9 in which means are provided to link the leg supports in certain operational configurations and un-link them in other operational configurations.

11. A worktable system according to claim 10 in which means are provided to lock the control-end leg support at one or more operating-angle settings to the top frame, this locked position functioning independently of any linkage with the far-end leg support.

12. A worktable system according to claim 11 in which means are provided for the far-end leg support to be positioned in a line parallel to the top frame, this positioning functioning independently of any linkage with the control-end legs.

13. A worktable system according to claim 12 providing a top frame aligner element which, positioned on the top frame extension support, extends the necessary positional line and form requirements of the original top frame support such that a worktop section functioning on the original maximum-operational-footprint for the worktop sections may equally fit and operate on the extended maximum-operational-footprint.

14. A worktable system according to claim 13 in which there is provided a top frame aligner along which a worktop section mount or worktop section may be selectively positioned and fixed.

15. A worktable system according to claim 13 in which there is provided a top frame aligner along which a worktop section mount and worktop section may be selectively positioned and fixed.

16. A worktable system according to claim 15 in which there is provided a top frame aligner which is displaceable along the top frame extension support and which is linked to the clamping/displacement means on the shorter maximum-operational-footprint such that activation of the said means produces the same clamping/displacement results on the extended maximum-operational-footprint as on the shorter.

17. A worktable system according to claim 16 in which the clamping/displacement means activates a primary clamping/displacement vehicle along which a secondary clamping/displacement vehicle may be selectively positioned and fixed, the secondary vehicle being employed to displace any attached tool or worktop section over a larger distance along the length of the primary vehicle and any extension linked to the said primary vehicle to a selected fixing point on the said primary vehicle or linked extension, the primary vehicle being employed to tighten and displacementely adjust the secondary vehicle with any attached tool or worktop section over the remaining smaller distance.

18. A worktable system according to claim 16 in which the clamping/displacement means activates a primary clamping/displacement vehicle along which a secondary clamping/displacement vehicle may be selectively positioned and fixed, the secondary vehicle being employed to displace any attached tool or worktop section over a larger distance along the length of the primary vehicle and any extension linked to the said primary vehicle to a selected fixing point on the said primary vehicle or linked extension, the primary vehicle being employed to tighten or displacementely adjust the secondary vehicle with any attached tool or worktop section over the remaining smaller distance.

* * * * *